US006209921B1

(12) United States Patent
Hogan et al.

(10) Patent No.: US 6,209,921 B1
(45) Date of Patent: Apr. 3, 2001

(54) SYSTEM AND METHOD FOR QUALITY ASSURANCE IN ANIMAL MEDICINE DELIVERY

(75) Inventors: Thomas Hogan, Marietta, GA (US); Darin Henry, Burns, OR (US)

(73) Assignee: Agecom, Inc., Marietta, GA (US)

( * ) Notice: Subject to any disclaimer, the term of this patent is extended or adjusted under 35 U.S.C. 154(b) by 0 days.

(21) Appl. No.: 09/503,820

(22) Filed: Feb. 15, 2000

(51) Int. Cl.[7] ..... B42D 15/00

(52) U.S. Cl. ..... 283/70; 283/67; 283/114; 283/81; 283/900; 206/534

(58) Field of Search ..... 206/425, 534; 347/110; 283/114, 81, 79, 80, 900, 67, 70, 74; 221/20; 40/310

(56) References Cited

U.S. PATENT DOCUMENTS 4,405,045 9/1983 Villa-Real .
4,473,156 9/1984 Martin .
4,883,180 11/1989 Humphrey et al. .
5,011,032 4/1991 Rollman .
5,115,930 5/1992 Lohrman et al. .
5,221,024 6/1993 Campbell .
5,730,292 3/1998 Jones .
5,857,275 * 1/1999 Deal ..... 40/310
5,924,739 * 7/1999 Garbutt ..... 283/81
5,931,304 * 8/1999 Hammond ..... 206/425
5,964,736 10/1999 Lane .
6,086,702 * 7/2000 Rea ..... 40/310

* cited by examiner

*Primary Examiner*—Willmon Fridie, Jr.
(74) *Attorney, Agent, or Firm*—William B. Dyer, III

(57) ABSTRACT

A plurality of medicine families having particular application to a species of animals are selected. A plurality of colors are selected, each color corresponding to a respective family of the plurality of medicine families. Containers containing the medicines from within the families of medicines are marked with a corresponding color.

8 Claims, 2 Drawing Sheets

SYSTEM AND METHOD FOR QUALITY ASSURANCE IN ANIMAL MEDICINE DELIVERY

FIELD OF THE INVENTION

The present invention relates to systems and methods for quality control in the administration of medicines to animals. More particularly, families of medicines are associated with a selected corresponding color. Containers containing medicines from the families of medicines are then marked with their selected corresponding color for ease of identification.

BACKGROUND

Occasional errors in the administration of medicines to animals such as cattle and hogs have historically been considered by the agri-business industry to be an inevitability. Such errors (including variations) most often fall into one of two categories: (a) the administration of improper medicines; or (b) the administration of proper medicines in improper amounts. These errors and variations are almost always attributable to either human error or the mechanical failure of the devices used to deliver the medicines. For some errors and variations, the consequences to the health of the animal and the ultimate safety of the food products produced by the animal are minor. In other cases, the consequences can be costly and catastrophic.

Recently, numerous advances have been made in the mechanical devices used to deliver medicines to animals, with a view toward reducing such errors and variations. Notably, the Marking Syringe of U.S. Pat. No. 5,961,494 has revolutionized both the efficiency of the actual medicine delivery and the reliability of marking the occurrence and location of medicine delivery to the subject animal. While the failure to mark an injected animal (or marking a non-injected animal) has been recognized as a human-introduced "weak link" in the integrity of animal medicine delivery systems which results in administration of improper amounts of medicine, this problem is solved with implementation of the Marking Syringe taught in the '494 patent. Nonetheless, other, more problematic human-introduced "weak links" in animal medicine delivery systems persist.

Specifically, overworked and often undertrained farmhands can be counted on to occasionally confuse the complex medical names for the numerous array of animal vaccines and medicines and, as a result, apply the wrong medicine to the wrong animal at the wrong time. Such confusion carries a high cost.

Animal medications, such as vaccines, are generally provided in clear or translucent plastic or glass bottles of a standard, generic shape. The contents of the bottles are noted on labels affixed to the outside of the bottle. The bottles are initially sealed by insertion of a rubber stopper in the opening (throat or neck) of the bottle. A metallic "cap" is then placed over the opening in the bottle to retain the stopper in place and provide a safety seal to indicate whether the bottle has been opened or otherwise tampered with after being filled by the manufacturer. As mentioned, the bottles all have basically the same shape and non-descriptive color. The rubber stoppers are usually a generic color such as orange-red (though they are occasionally black or grey), and the caps are usually silver. Because most medicines have no distinguishing coloration of their own, the labels on the bottle are normally the sole means of visual determination of bottle contents. As such, the person retrieving bottles of medicine from a storage cooler or a refrigerator must make an accurate reading of the name of the medicine indicated on the label in order for the proper medicine to be administered to the animals.

With most animals, basic medicines given the animals can be divided into a limited number of general groups. In the case of cattle, which will hereafter be used as an example, the major types of medicines given fall into the general families of upper respiratory, clostridial, venereal/reproductive, antibacterial and antibiotic.

The administration of a medicine from an improper medicine family may carry grave consequences for the animal, costly consequences for the producer, and unknown consequences for the consumer. For example, the RB-51 vaccine is designed to ameliorate the effects of infection by the brucellosis virus and, thereby prevent unwanted abortion in female animals. As with many animal vaccines, the RB-51 vaccine is a "modified live virus" vaccine, meaning that a small amount of the living virus (in a highly attenuated form) is contained in the vaccine. When the vaccine is administered to the animal, the animal's immune system attacks and destroys the attenuated living virus. During this process, the animal normally develops sufficient immunity to the virus to avoid contracting the virus from outside sources.

This particular vaccine (RB-51) is specifically designed for application to female animals. Because this vaccine is only applied to female animals, subsequent tests of these animals will often reveal low levels of the brucellosis virus. At that time, the cattleman can check the medical history of the animal to verify that RB-51 was administered. If so, and if the administration was within sufficiently close time proximity to explain the corresponding brucellosis level detected in the animal, the test result is "normal" and operations continue.

If this vaccine is given to a male animal by mistake, detection of the brucellosis virus in the animal will cause deep concern and drastic measures on the part of the cattleman. There is presently no easy way to determine that the brucellosis was introduced by an accidental injection of the RB-51 vaccine. Instead, the cattleman must assume the possibility of an outbreak of brucellosis among the herd and take immediate remedial measures, at a significant cost in terms of dollars and time. Furthermore, if a group of male animals mistakenly received the RB-51 vaccine instead of a different scheduled medication, the animals have not received all of the medications they were expected to receive, possibly exposing them to other risks. Even if the mistake is detected after injection, the animals will then likely be injected with the originally intended medication, resulting in increased (and highly undesirable) levels of pharmacological residue is the derivative food products.

It is entirely possible that a male animal improperly injected with RB-51 may be destroyed, as a consequence of the above-referenced issues. Losing one animal to such a mistake is not good, but the reality of farm operations is such that any such mistake would be multiplied many times over. Specifically, one bottle of RB-51 vaccine, like most other vaccines and medicines, provides a sufficient quantity to inject at least 50, and maybe as many as 150 animals. Thus, a single error in setting up an injection system with an improper vaccine could mean necessary destruction of many dozens of head of cattle. The economic impact of such an error could be catastrophic in both the short term and long term.

Accordingly, there is an acute need for a system and method which will reduce or eliminate accidental administration of improper medicines to animals.

SUMMARY OF THE INVENTION

A system and corresponding method for quality control in the administration of medicines to animals satisfies the foregoing need by identifying a particular group of animals for application of the principles of the present invention. Thereafter, families of medicines which are commonly given to the group of animals are identified. A plurality of different colors are selected for association with the families of medicines, then each family of medicines is associated with a single selected color from among the plurality of colors. The system and corresponding method of the present invention are completed when the containers containing medicines belonging to a particular family of medicines are marked in such a way as to make visually conspicuous the color coordinated association between the contents of the medicine bottle and to the family of medicines to which the medicine belongs.

DETAILED DESCRIPTION

Figure 1:
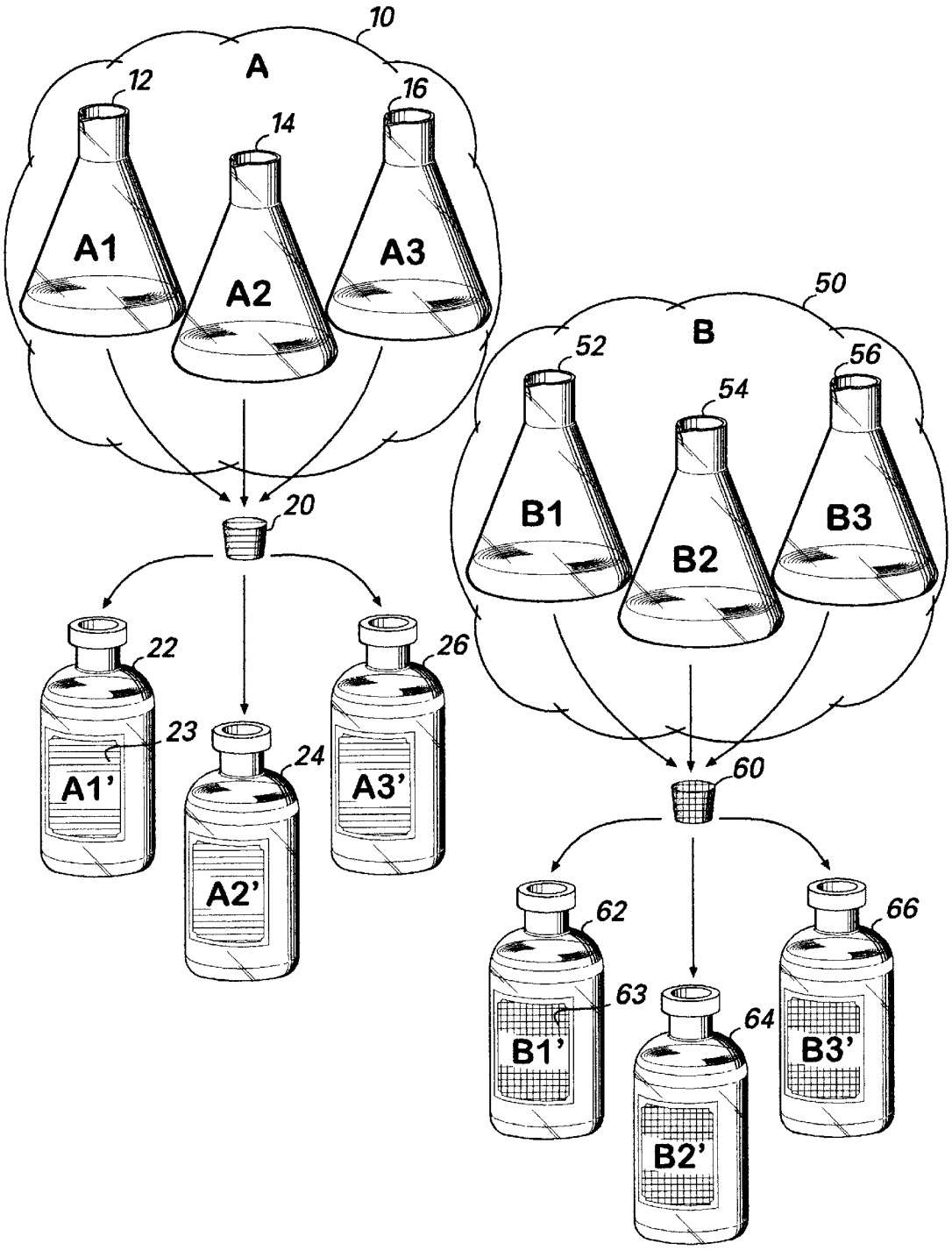
FIG. 1 depicts an exemplary system for grouping and marking animal medications in accordance with a preferred embodiment of the present invention.

FIG. 1 depicts an exemplary system for grouping and marking animal medications in accordance with a preferred embodiment of the present invention.

At the outset, it will be understood and appreciated that the objectives satisfied by the present invention are equally applicable to a wide variety of animal species, including cattle, hogs, and even humans. Furthermore, the principles of the present invention may apply to groups of animals such as combined multiple species or defined subsets of a single species. For simplicity of illustration and avoidance of unnecessary redundancy, illustrative representations made hereafter will relate to cattle only.

Referring now to FIG. 1, medicine families such as medicine family A 10 and medicine family B 50 are identified from among the vast numbers of different medicines available for administration to cattle. Importantly, medicine families such as medicine family A 10 and medicine family B 50 comprise different families of medicines. Examples of possible different medicine families relating to the cattle industry include upper respiratory, clostridial, venereal/reproductive, antibacterial, and antibiotic. In the depicted scheme, all medicines fitting within one of the medicine families identified for a species, such as clostridials, for example, are categorized in a single medicine family such as medicine family A 10 or medicine family B 50.

In the depiction of FIG. 1, medicine family A 10 comprises three different medicines, medicine A1 12, medicine A2 14, and medicine A3 16. For simplicity of illustration, only three medicines are shown in medicine family A 10, though it is understood and appreciated that any particular medicine family may include a much greater number of currently existing and later developed medicines which meet the criteria for inclusion in a particular medicine family.

When grouping medicines into a medicine family such as medicine family A 10, medicines included in a given medicine family may be the same medicines manufactured by different manufacturers and, thus, having slightly different characteristics. Other medicines which may be included in the same medicine group include different medicines formulated to resolve similar medical problems. In the example of medicines in the clostridial medicine family, for example, a variety of medicines currently exist which would be included in such a medicine family, to include 4-way black leg, 7-way black leg, 8-way black leg, and others. Even though each of these medicines are different, they all may be included in the so-called "clostridial" medicine group.

After a group of medicines has been grouped into a particular medicine family such as medicine family A 10, a distinguishing color is identified and associated with medicine family A 10. In the depicted example, the color blue is pseudo-arbitrarily selected. The selection of a color is pseudo-arbitrary in that the color should be a color not already selected for association with another medicine family, and the color should not be the reddish-orange (or occasionally black or grey) colors historically used for sealing containers of all different medicine varieties. Apart from these considerations, the color selection is arbitrary.

Importantly, after selection of a color for association with a family of medicines such as the color blue with medicine family A 10, a colored sealing stopper 20 of the color associated with medicine family A 10 is produced in a well known manner. In the present example, colored sealing stopper 20 is blue.

Before distribution of medicines through various distribution channels, medicines A1 12, A2 14, and A3 16 are transferred to corresponding medicine bottles A1' 22, A2' 24, and A3' 26 for distribution and ultimate sale to end users. By "corresponding" medicine bottles, it will be appreciated that medicine A1 12 is transferred to medicine bottles such as A1' 22, and the like. This correspondence is significant because each of the medicines A1 12, A2 14, and A3 16 belonging to medicine family A 10 may be different. Differences between medicines within the same medicine family such as medicine family A 10 are denoted by distinguishing labels affixed to each medicine bottle such as medicine bottles A1' 22, A2' 24, and A3' 26, as has been the standard for many years. In an optional embodiment of the present invention, a medicine bottle label such as medicine bottle label 23 may be color coded to correspond to the color associated with the medicine family to which the contents of the medicine bottle 22 correspond. In the depicted example, medicine bottle label 23 would be coded with a blue color, thereby corresponding to the color of the container sealing stopper 20 which, itself corresponds to the color chosen for association with medicine family A 10. Optional embodiments of the present invention include marking the medicine bottles A1' 22, A2' 24, and A3' 26 in any manner so as to associate the respective medicine bottle with the corresponding color chosen for association with the medicine family A 10, including forming the bottle itself of a material capable of carrying the corresponding color.

The same grouping and association principles apply to other medicine families, such as medicine family B 50 which may be a medicine family comprising upper respiratory medicines, for example. In the same fashion as with medicine family A 10, medicine family B 50 comprises three different medicines, medicine B1 52, medicine B2 54, and medicine B3 56. For simplicity of illustration, only three medicines are shown in medicine family B 50, though it is understood and appreciated that any particular medicine family may include an unlimited number of currently existing and later developed medicines which meet the criteria for inclusion in a particular medicine family.

After a group of medicines has been grouped into a particular medicine family such as medicine family B 50, a distinguishing color is identified and associated with medicine family B 50. In the depicted example, the color blue has already been selected for association with medicine family A 10, so a different color, yellow, is selected.

Importantly, after selection the color yellow for association with medicine family B 50, a colored sealing stopper 60 of the color associated with medicine family B 50 is produced in a well known manner. In the present example, colored sealing stopper 60 is yellow.

Before distribution of medicines through various distribution channels, medicines B1 52, B2 54, and B3 56 are transferred to corresponding medicine bottles B1' 62, B2' 64, and B3' 66. By "corresponding" medicine bottles, it will be appreciated that medicine B1 52 is transferred to medicine bottles such as B1' 62, and the like. As with the medicines of medicine family A 10, medicine bottles such as medicine bottle B1' 62 may carry or have otherwise affixed a medicine bottle label 63 which corresponds in color to the container sealing stopper 60. In the depicted example, medicine bottle label 63 would be coded with a yellow color.

The principal improvement provided by the preferred embodiment of the present invention relates to the use of colored sealing stoppers 20, 60 of a single, distinguishable color for all different medicines within the same medicine family. With reference to the depicted example, even though the medicines contained in medicine bottles A1' 22, A2' 24, and A3' 26 are different, they will each be sealed with a blue colored sealing stopper such as colored sealing stopper 20 because blue was the color chosen for association with all medicines included in medicine family A 10. Similarly, even though the medicines contained in medicine bottles B1' 62, B2' 64, and B3' 66 are different, they will each be sealed with a yellow colored sealing stopper such as colored sealing stopper 60 because blue was the color chosen for association with all medicines included in medicine family B 50.

Figure 2A:
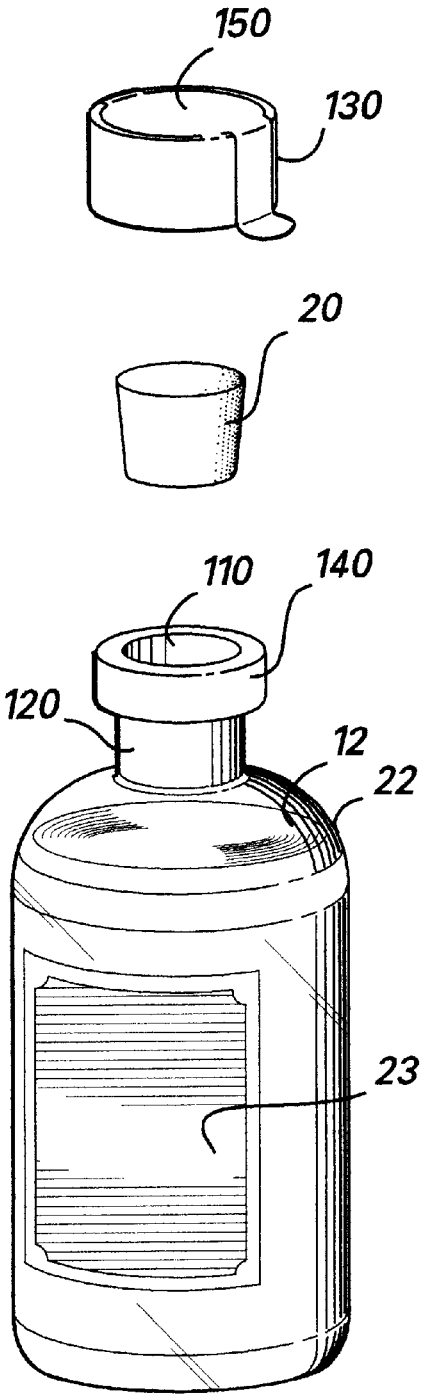
FIGS. 2*a* and 2*b* depict the implementation of an exemplary embodiment of the system of the present invention.
Figure 2B:
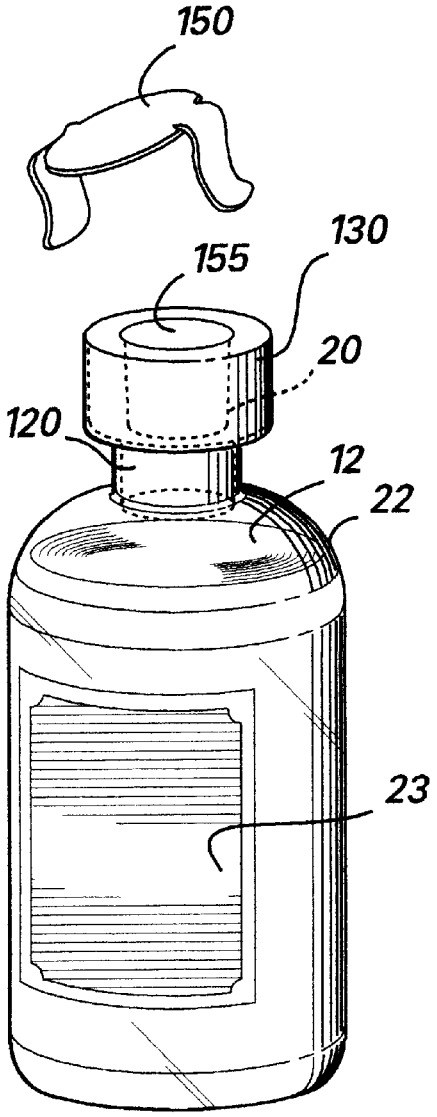

FIGS. 2*a* and 2*b* depict the implementation of an exemplary embodiment of the system of the present invention. More specifically, FIG. 2*a* depicts medicine bottle A1' 22 filled with medicine A1, with medicine bottle label 23 affixed to the medicine bottle A1' 22, and with various medicine bottle sealing components illustrated in exploded view.

In particular, it is well known in the art to seal medicine bottles such as medicine bottle A1' 22 with a sealing stopper. In an embodiment of the present invention, the sealing stopper is a colored sealing stopper 20. The colored sealing stopper 20 is sized to fit within an opening 110 defined within the neck 120 of the medicine bottle A1' 22 in a leak-proof fashion. Additionally, it is preferred that a metal cap 130 be sized to securely fit over a bottle lip 140 at the top edge of the medicine bottle A1' 22 to prevent tampering with the medicine A1 12 within the medicine bottle A1' 22. Regarding the metal cap 130, a satiation cover 150 is often removably incorporated therein to allow access to the container sealing stopper 20 and, ultimately, to the medicine A1 within the bottle. Optionally, the metal cap 130 may be color coded in the same fashion as the colored sealing stopper 20.

FIG. 2*b* depicts the various medicine bottle sealing components in an installed configuration. The colored sealing stopper 20 has been inserted into the opening 110 defined by the neck 120 of the medicine bottle A1' 22. The metal cap 130 has been placed over the bottle lip 140 and secured thereon in a manner well known to those skilled in the art. In an initial configuration (not shown), satiation cover 150 would remain integral to the metal cap 130 until the medicine bottle A1' 22 was being prepared for use. FIG. 2*b* depicts, however, the metal cap 130 after removal of the satiation cap 150, thereby revealing satiation access 155. Importantly, satiation access 155 exposes the colored sealing stopper 20 for both visual inspection and insertion of a "draw off" through the colored sealing stopper 20 and into the interior of medicine bottle A1' 22 for removal of the medicine A1 12.

An advantage of the system of the preferred embodiment of the present invention becomes clear when considering the illustration of FIG. 2*b*. After insertion of the colored sealing stopper 20 into the bottle, a technician or other individual preparing to administer the medicine can visually identify the color of the stopper through the clear or translucent neck 120 of the medicine bottle A1' 22. The color of the colored sealing stopper 20 should correspond to the color of the medicine bottle label 23. Furthermore, as the technician removes the satiation cover 150 from the metal cap 130 and prepares to insert a draw-off (typically comprising a long needle or sharpened pipette) through the colored sealing stopper, there is not choice but to notice the color of the colored sealing stopper 20. Again, if the color seen by the technician does not correspond to either the instructions given the technician by a supervisor or the color of the medicine bottle label 23, the technician is alerted of a potential problem.

Although specific attention has been directed to the preferred embodiments of the present invention, it will be understood and appreciated that other equivalent embodiments are easily achieved within the spirit and scope of the present invention. Particularly, yet another alternate embodiment may include a medicine bottle such as medicine bottle A1' 22 being formed of a material colored the color associated with its contents. In the present example, the medicine bottle A1' 22 could be formed of blue plastic, blue glass, or simply painted or otherwise all or partially covered to as to indicate the family of medicines from which its contents derive.

As such, it is specifically intended that the scope of the present invention not be limited to the embodiments described hereinabove, but by the claims appended hereto.

We claim:

1. A system for quality control in the administration of medicines to animals, comprising:

a. identification of a group of animals;

b. selection for identification of a plurality of medicine families each comprising at least one medicine typically applied to the identified group of animals;

c. selection of a plurality of different colors for association with the plurality of medicine families;

d. association of a single selected color of the plurality of different colors with a single selected medicine family from the plurality of medicine families; and e. providing a medicine bottle containing a medicine from the single selected medicine family marked with the single selected color.

2. The system of claim 1, wherein the medicine bottle is marked with a container sealing stopper of the single selected color.

3. The system of claim 1, wherein the medicine bottle is marked by an affixed label, the affixed label having markings corresponding to the single selected color.

4. A method for quality control in the administration of medicines to animals, comprising:

a. identifying a group of animals;

b. selecting for identification a plurality of medicine families each comprising at least one medicine typically applied to the identified group of animals;

c. selecting a plurality of different colors for association with the plurality of medicine families;

d. associating a single selected color of the plurality of different colors with a single selected medicine family from the plurality of medicine families; and e. marking a medicine bottle containing a medicine from the single selected medicine family with the single selected color.

5. The method of claim 4, wherein the marking step comprises the additional step of placing a colored sealing stopper of the single selected color in an opening of the medicine bottle.

6. The method of claim 4, wherein the marking step comprises the additional step of affixing a label of the single selected color on the medicine bottle.

7. The method of claim 4, wherein the marking step further includes the step of marking the medicine bottle by manufacturing the medicine bottle in a material carrying the single selected color.

8. The method of claim 4, wherein the marking step comprises the additional step of marking the medicine bottle by affixing a metal cap carrying the single selected color.

* * * * *